US009162735B2

(12) United States Patent
Grainger

(10) Patent No.: US 9,162,735 B2
(45) **Date of Patent: *Oct. 20, 2015**

(54) INFLATABLE EVACUATION SLIDE

(71) Applicant: Michael Grainger, Tasmania (AU)

(72) Inventor: Michael Grainger, Tasmania (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/742,117

(22) Filed: Jan. 15, 2013

(65) Prior Publication Data

US 2014/0196986 A1 Jul. 17, 2014

Related U.S. Application Data

(63) Continuation-in-part of application No. 12/672,438, filed as application No. PCT/AU2008/001262 on Aug. 28, 2008, now Pat. No. 8,376,082.

(51) Int. Cl.

| | |
|---|---|
| ***B63C 9/00*** | (2006.01) |
| ***B63B 27/30*** | (2006.01) |
| ***A62B 1/20*** | (2006.01) |
| *B63B 27/14* | (2006.01) |

(52) U.S. Cl.

CPC . *B63B 27/30* (2013.01); *A62B 1/20* (2013.01); *B63B 2027/145* (2013.01)

(58) Field of Classification Search

CPC B63B 2027/145; B63B 7/08; B63B 35/7913; B63B 27/30; A62B 1/20; E01D 15/122

USPC ..... 182/48; 52/2.11, 2.18, 2.23, 2.24, 2.22, 52/650.1, 650.2; 114/345, 354, 362; 441/39, 40; 244/137.2, 905, 118.3; 14/2.4

See application file for complete search history.

(56) References Cited

U.S. PATENT DOCUMENTS

| | | | | |
|---|---|---|---|---|
| 2,211,104 | A * | 8/1940 | Doiguchi | 441/127 |
| 2,986,751 | A * | 6/1961 | Baren | 441/66 |
| 3,621,383 | A * | 11/1971 | Rush et al. | 324/414 |
| 3,679,025 | A * | 7/1972 | Rummel | 182/20 |
| 4,206,933 | A * | 6/1980 | Koch | 280/18 |
| 4,332,049 | A * | 6/1982 | Fisher | 441/80 |
| 4,378,861 | A * | 4/1983 | Burrough et al. | 182/48 |
| 4,519,782 | A * | 5/1985 | Fisher | 441/40 |
| 4,846,422 | A * | 7/1989 | Fisher | 244/137.2 |
| 5,311,706 | A * | 5/1994 | Sallee | 52/2.18 |

(Continued)

FOREIGN PATENT DOCUMENTS

| | | |
|---|---|---|
| AU | B-10585/95 | 6/1995 |
| GB | 854627 A | 11/1960 |

(Continued)

*Primary Examiner* — Daniel Cahn

(74) *Attorney, Agent, or Firm* — Edwin D. Schindler

(57) ABSTRACT

An inflatable evacuation slide includes a base, one or more top tubes, a first lateral side, including a series of alternately upright and inverted generally triangular inflatable frames, each frame being coupled to neighboring frames in the series, a first common side of the base and at least one of said top tubes, and a second lateral side including a series of alternately upright and inverted generally triangular inflatable frames, each frame being coupled to neighboring frames in the series, a second common side of the base and at least one of said top tubes. The first common side of the base is opposite the second common side of the base so that the slide is generally triangular in cross-section, and the angles of the triangular frames combine to form an upwardly directed arcuate bend in the uninflated slide which straightens under the weight of the slide when inflated and deployed.

5 Claims, 4 Drawing Sheets

(56) References Cited

U.S. PATENT DOCUMENTS

| | | | | |
|---|---|---|---|---|
| 5,469,686 | A * | 11/1995 | Pykiet | 52/793.11 |
| 6,298,970 | B1 * | 10/2001 | Targiroff et al. | 193/25 B |
| 6,536,715 | B1 * | 3/2003 | Moran et al. | 244/137.2 |
| 6,655,633 | B1 * | 12/2003 | Chapman, Jr. | 244/123.9 |
| 6,966,414 | B2 * | 11/2005 | Zonneveld | 193/5 |
| 7,063,763 | B2 * | 6/2006 | Chapman, Jr. | 156/175 |
| 7,185,600 | B2 * | 3/2007 | Toussi et al. | 114/345 |
| 7,574,830 | B2 * | 8/2009 | Baker | 52/2.18 |
| 7,789,761 | B1 * | 9/2010 | Lumsden | 472/116 |
| 8,376,082 | B2 * | 2/2013 | Grainger | 182/48 |
| 2002/0117354 | A1 * | 8/2002 | Baker et al. | 182/48 |
| 2005/0040290 | A1 * | 2/2005 | Suhami | 244/146 |
| 2005/0114998 | A1 * | 6/2005 | Leventhal et al. | 5/615 |
| 2008/0066393 | A1 * | 3/2008 | Sorensen | 52/81.1 |
| 2010/0058672 | A1 * | 3/2010 | Bayne | 52/2.11 |
| 2011/0259668 | A1 * | 10/2011 | Grainger | 182/48 |
| 2012/0100765 | A1 * | 4/2012 | Simon Bouhet et al. | 441/39 |
| 2013/0210562 | A1 * | 8/2013 | Zawitz | 473/570 |

FOREIGN PATENT DOCUMENTS

| | | | | |
|---|---|---|---|---|
| GB | 869067 | A | 5/1961 | |
| GB | 2105264 | A | 3/1983 | |
| GB | 2131369 | A | 6/1984 | |
| GB | 2168008 | A | 6/1986 | |
| SU | 898704 | A1 | 6/1990 | |
| WO | WO 95/14605 | A1 | 6/1995 | |
| WO | WO 95/15787 | A1 | 6/1995 | |
| WO | WO 2009026631 | A1 * | 3/2009 | B63B 27/14 |

* cited by examiner

INFLATABLE EVACUATION SLIDE

CROSS-REFERENCE TO RELATED APPLICATION

This is a continuation-in-part of U.S. patent application Ser. No. 12/672,438, now U.S. Pat. No. 8,376,082, which represents the U.S. National Phase of P.C.T. Application No. PCT/AU2008/001262, filed Aug. 28, 2008.

FIELD OF THE INVENTION

The present invention relates to an inflatable evacuation slide.

DESCRIPTION OF THE PRIOR ART

For many years the use of conventional lifeboats on board ships presented problems with respect to on board stowage, release and passenger loading. The latter two functions being effected only with the deployment of considerable manpower.

With the more recent development of inflatable liferafts however these require means for quickly and safely loading passengers.

This desirability for quick, safe evacuation procedures in turn led to the development of inflatable slides which are used by passengers to slide into the liferaft which is deployed in the water. These slides are known to rapidly inflate such that passengers can be quickly evacuated.

In order to improve passenger safety liferaft slides of this type have been developed which are relatively enclosed, to prevent a passenger falling, while being generally triangular in cross-section to increase both strength and stability. These inflatable slides do however have the disadvantage that not only will they sag with the weight of occupants on the slide but are known to sag downwards under their own weight. This in turn increases the risk of "buckling" under load.

SUMMARY OF THE INVENTION

In accordance with the invention, there is provided an inflatable evacuation slide, comprising:

(a) base;

(b) one or more top tubes;

(c) a first lateral side including a series of alternately upright and inverted generally triangular inflatable frames, each frame of said frames being coupled to neighboring frames in the series, a first common side of the base and at least one of said top tubes; and (d) a second lateral side including a series of alternately upright and inverted generally triangular inflatable frames, each frame of said frames being coupled to neighboring frames in the series, a second common side of the base and at least one of said top tubes, wherein the first common side of the base is opposite the second common side of the base so that the slide is generally triangular in cross-section, and wherein angles of the triangular frames combine to form an upwardly directed arcuate bend in the uninflated slide which straightens under the weight of the slide when inflated and deployed.

Preferably, the inflatable evacuation slide provides in a marine evacuation system an inflatable evacuation slide which has a structure such that the slide is self supporting under its own weight when inflated and also when it is loaded with passengers.

It is preferred that the evacuation slide be deployed between a vessel and a liferaft.

It is also preferred that the slide when inflated be straight under both its own weight and that of those using it for marine evacuation purposes.

Preferably, a left hand side of each successive upright triangular frame in the series of frames, when taken from left to right, increases in angle with respect to a horizontal and a right hand side each successive upright triangular frame in the series of frames, when taken from left to right, decreases in angle with respect to a horizontal. Angles of left and right sides of the series of triangular frames combine to form the upwardly directed arcuate bend in the uninflated slide which straightens under the weight of the slide when inflated and deployed.

Other objects and features of the present invention will become apparent when considered in combination with the accompanying drawing figures, which illustrate certain preferred embodiments of the present invention. It should, however, be noted that the accompanying drawing figures are intended to illustrate only a limited number of preferred embodiments of the claimed invention and are not intended as a means for defining the limits and scope of the invention.

BRIEF DESCRIPTION OF THE DRAWING FIGURES

Preferred embodiments of the present invention are hereafter described, by way of non-limiting example only, with reference to the accompanying drawing figures in which.

DETAILED DESCRIPTION OF THE DRAWING FIGURES AND PREFERRED EMBODIMENTS

Figure 1:
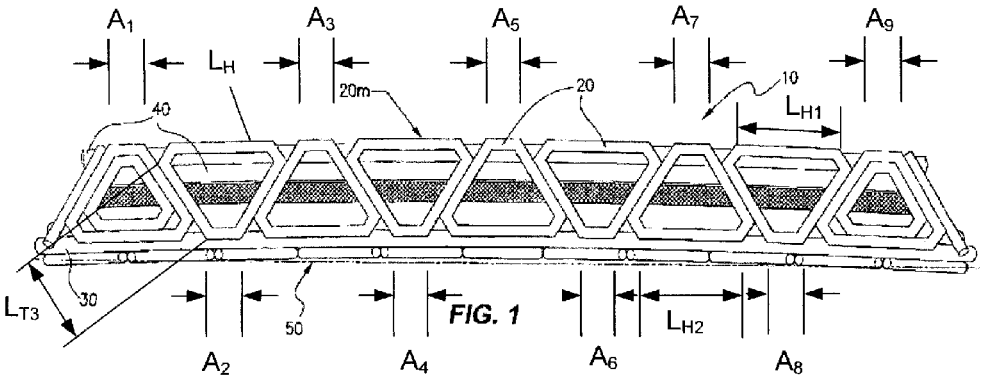
FIG. 1 is a side view of an inflatable evacuation slide when not under load.

In the preferred embodiment of the invention a 20 m slide is described although the concept of the invention applies generally to evacuations slides. These slides are subject to a combination of bending loads acting perpendicular to the slide and compressive loads acting parallel to the slide.

Most evacuation slides deflect or bend under their own weight which increases a slide's susceptibility to buckling deformation. In contrast the slide of the invention is designed and manufactured such that it becomes straight under its own weight when deployed.

The rigidity of the slide 10 is provided by forming the slides from interlocking generally triangular frames 20 that join to each other as well as the main slide frame 30 and top tubes 40, the angles of the triangular frames being determined such that when joined together an upwardly directed bend 50 in the slide is formed which straightens under the weight of the slide when inflated and deployed.

Figure 3:
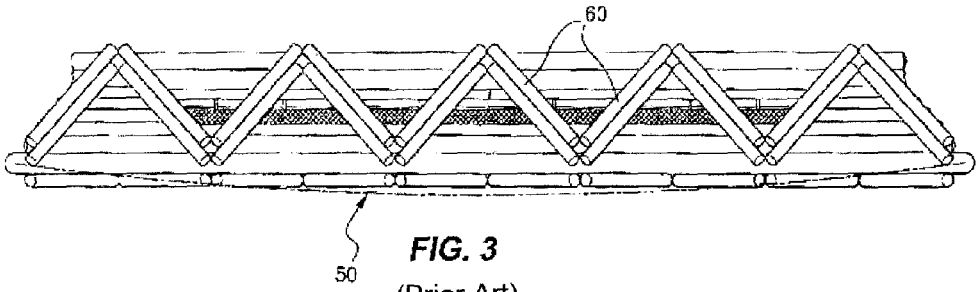
FIG. 3 (Prior Art)
FIG. 3 is a side view of a conventional marine evacuation slide.

In contrast a conventional marine evacuation slide is shown in FIG. 3 and as can be seen the side brace tube assemblies 60 used to strengthen the lateral sides 65 are unconnected to each other and do not act to prevent movement which will lead to sagging under its own weight even in the absence of any additional passenger load.

Figure 2:
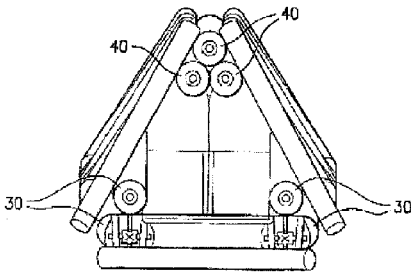
FIG. 2 is an end view of the slide shown in FIG. 1.
Figure 4:
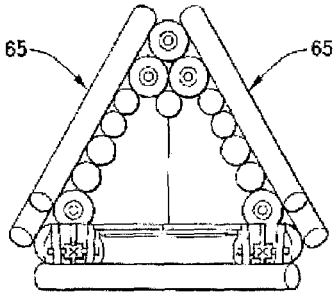
FIG. 4 (Prior Art)
FIG. 4 is an end view of the slide shown in FIG. 3.

The marine evacuation slides are triangular in cross-section as shown in FIGS. 2 and 4 as this is a shape which provides the simplest structurally sound mode of construction. The length of the slide used will also vary depending on the drop height required. The embodiment of the invention described however is 20 m in length.

As discussed here conventional slides (shown in FIG. 3) tend to sag under their own weight and the more a slide sags the more susceptible it becomes to both buckling loads and bending loads thereby impairing its required function.

The slide design of the invention as shown in FIG. 1 provides a pre-bending arrangement 50 to the outstretched uninflated slide which directs it arcuately above the horizontal as shown.

When the slide is inflated the interlocking frames 20 act upon one and other when the slide is deployed such that, while any residual sag causes the slide to become straight, further downwards movement of the base 30 of the slide is restricted by the slide structure.

This result is achieved by the use of the tesselated interlocking triangular side braces as shown. While the precise shape of these members is not restricted in the invention the arrangement shown in FIG. 1 has proved to be most effective.

In this embodiment of the invention all the individual inflatable tubes of the slide are manufactured from a polyurethane coated nylon fabric using high frequency welding techniques.

The material used to manufacture these tubes is not restricted in the invention neither are the bonding and fabrication techniques used in manufacture in general, however all materials and methods of manufacture must comply with the relevant legislative requirements.

The base of the slide may be of any type preferred and is also not restricted in the invention neither is a strictly triangular cross section although the latter is preferred for strength considerations.

While the triangular side bracing members used to form the side walls of the slide are unique to the invention any slide construction which provides for an initially arcuately shaped slide base and orientation, which becomes straight when the slide is inflated, lies within the scope of the invention as does the use of tesselated side frame members.

Other design features of the slide relevant to materials used and details of interior bracing and the like can also be varied in the invention.

The invention described here provides a structurally sound evacuation slide for a liferaft which safely encloses the evacuating passengers and maintains its required shape in use and while we have described here one specific embodiment of the invention it is to be understood that variations and modifications in this can be made without departing from the spirit and scope of the invention.

Figure 5:
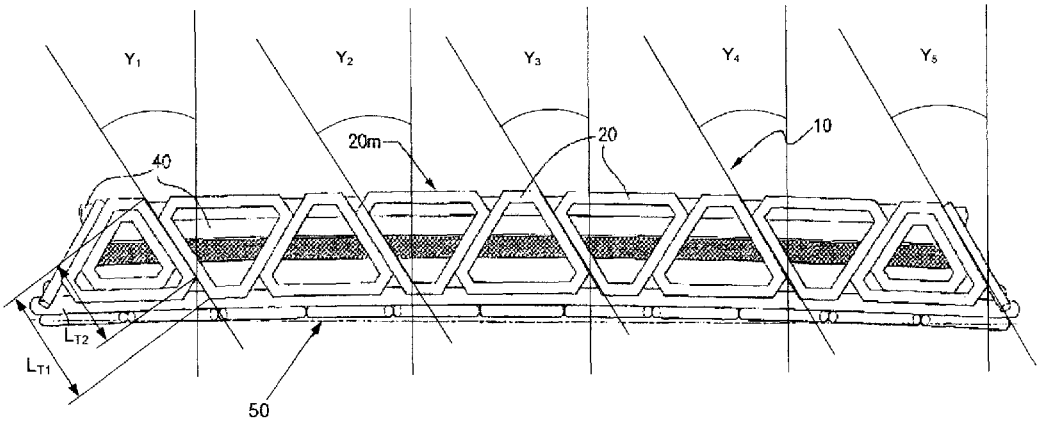
FIG. 5 is another side view of the slide shown in FIG. 1.
Figure 6:
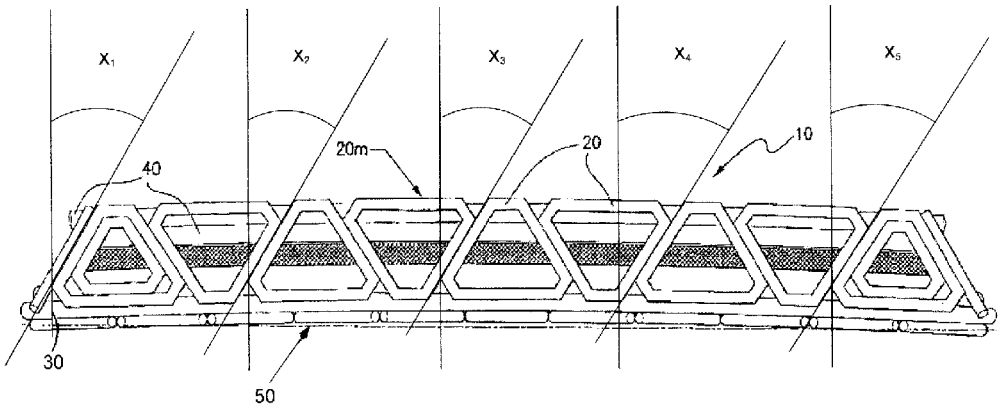
FIG. 6 is another side view of the slide shown in FIG. 1.

The preferred embodiment of the slide shown in FIGS. 1, 5 and 6, has the following dimensions:

$X_1$=23.25°
$X_2$=26.25°
$X_3$=29.25°
$X_4$=32.25°
$X_5$=35.25°
$Y_1$=35.25°
$Y_2$=32.25°
$Y_3$=29.25°
$Y_4$=26.25°
$Y_5$=23.25°
$A_1$=715 mm
$A_2$=647 mm
$A_3$=715 mm
$A_4$=647 mm
$A_5$=715 mm
$A_6$=647 mm
$A_7$=715 mm
$A_8$=647 mm
$A_9$=715 mm
$L_{T1}$=2575 mm
$L_{T2}$=2064 mm
$L^{T3}$=2035 mm
$L_{H1}$=2239 mm
$L_{H2}$=2171 mm

The angles $X_1$ to $X_5$ between the frames 20 progressively increase from 23.25° to 35.25° from left to right and the angles $Y_1$ to $Y_5$ between the frames 20 progressively decrease from 35.25° to 23.25° from left to right. The increasing and decreasing angles between the frames 20 combine to form an upwardly directed arcuate bend 50 in the uninflated slide 10 which straightens under the weight of the slide when inflated and deployed.

Of course, the slide 10 can include any other suitable dimensions the combine to produce an upwardly directed arcuate bend 50 in the uninflated slide 10 which straightens under the weight of the slide when inflated and deployed.

The above-described dimensions will vary to suit the needs of any particular vessel on which the slide is to be installed. Further, the dimensions and angles are not immutable and will vary depending on the characteristics of the fabric used and on the inflation pressure of the slide. For the sake of consistency, the values given are based on the following conditions:

a. No significant fabric stretch; and
b. Sufficient inflation to make the slide take proper shape.

While only several embodiments of the present invention have been shown and described, it will be obvious to those skilled in the art that many modifications may be made to the present invention without departing from the spirit and scope thereof

What is claimed is:

1. An inflatable evacuation slide, comprising:
base;
one or more top tubes;
a first lateral side including a series of alternately upright and inverted substantially triangular inflatable frames, each frame of said frames being coupled to neighboring frames in the series, a first common side of the base and at least one of said one or more top tubes; and
a second lateral side including a second series of alternately arranged upright and inverted substantially triangular inflatable frames, each frame of said frames of the second series of alternately arranged upright and inverted frames being coupled to neighboring frames of the second series, a second common side of the base and at least one of said one or more top tubes,
wherein the first common side of the base is opposite the second common side of the base so that the slide is substantially triangular in cross-section, and
wherein angles of the triangular frames of the first lateral side and the second lateral side combine to form an upwardly directed arcuate bend in the slide configured to straighten under a weight of the slide when arranged in an inflated condition of use and deployed.

2. The inflatable evacuation slide according to claim 1, wherein apexes of the triangular frame members are squared off.

3. The inflatable evacuation slide according to claim 1, wherein the slide, when inflated, is straight under both its own weight and that of one or more people using the slide during an evacuation.

4. The inflatable evacuation slide according to claim 3, wherein a left hand side of each successive upright triangular frame in the first series of frames, when taken from left to right, increases in angle with respect to a horizontal, and a right hand side of each successive upright triangular frame in the series of frames, when taken from left to right, decreases in angle with respect to the horizontal, and wherein a left hand side of each successive upright triangular frame in the second series of frames, when taken from left to right, increases in angle with respect to the horizontal, and a right hand side of each successive upright triangular frame in the second series of frames, when taken from left to right, decreases in angle with respect to the horizontal.

5. The inflatable evacuation slide claimed in claim 4, wherein angles of left and right sides of the series of triangular frames and angles of left and right sides of the second series of triangular frames combine to form the upwardly directed arcuate bend in the slide which straightens under the weight of the slide when inflated and deployed.

* * * * *